United States Patent [19]

Leboeuf

[11] 4,422,359

[45] Dec. 27, 1983

[54] ADJUSTABLE SLITTER BLADE HOLDER

[75] Inventor: William E. Leboeuf, Midland, Mich.

[73] Assignee: The Dow Chemical Company, Midland, Mich.

[21] Appl. No.: 309,314

[22] Filed: Oct. 7, 1981

[51] Int. Cl.[3] ..... B26D 1/03

[52] U.S. Cl. ..... 83/546; 83/563; 83/858; 83/700

[58] Field of Search ..... 83/881, 875, 509, 433, 83/856, 858, 698, 529, 545, 546, 700, 563

[56] References Cited

U.S. PATENT DOCUMENTS

| | | | |
|---|---|---|---|
| 1,000,664 | 8/1911 | Brownrigg | 83/433 X |
| 1,871,334 | 8/1932 | McNeill | 83/563 X |
| 3,122,335 | 2/1964 | Dusenbery et al. | 242/56.2 |
| 3,161,364 | 12/1964 | House | 242/56.2 |
| 3,282,525 | 11/1966 | Rehr | 242/56.2 |
| 3,320,111 | 5/1967 | Lucia et al. | 83/433 X |
| 3,591,101 | 7/1971 | Gallet et al. | 242/56.2 |
| 3,682,031 | 8/1972 | Degelleke et al. | 83/433 |
| 3,712,344 | 1/1973 | Kovacec | 139/11 |
| 3,742,793 | 7/1973 | Gray et al. | 83/881 |
| 3,752,021 | 8/1973 | Klien | 83/875 X |
| 4,015,791 | 4/1977 | Price | 242/56.2 |
| 4,070,936 | 1/1978 | Duncan | 83/563 |
| 4,094,217 | 6/1978 | Exline | 83/582 |
| 4,094,474 | 6/1978 | Stollenwerk et al. | 242/56.2 |
| 4,254,677 | 3/1981 | Evans | 83/13 |

FOREIGN PATENT DOCUMENTS

| | | | |
|---|---|---|---|
| 509241 | 7/1939 | United Kingdom | 83/881 |
| 604482 | 7/1948 | United Kingdom . | |
| 1004503 | 9/1965 | United Kingdom . | |
| 1271719 | 4/1972 | United Kingdom . | |
| 1370087 | 10/1974 | United Kingdom . | |

*Primary Examiner*—James M. Meister
*Attorney, Agent, or Firm*—D. R. Howard

[57] ABSTRACT

An apparatus for longitudinally slitting moving webs of material. The apparatus provides for adjustment of cutting blade engagement with a moving web during slitting. The apparatus also provides for a consistent blade cutting angle as well as for increased use of a blade cutting edge. Further, the apparatus markedly reduces operator exposure to blade cutting edges.

10 Claims, 11 Drawing Figures

150
157
153
152
156
155
151

75
142
148
145
147
140
144
139
138
146
143
141

138
139
142
75
145
144
138
143
141

58
116
110
119
117
121
123
108
107
115
109
118
113
122
112

131
128
129
132
23
127
136

107
115
109
117
112
113
122
108
58
118
111
121

23
131
126
127
132
136
10
10
130
135
125
129
133

ADJUSTABLE SLITTER BLADE HOLDER

BACKGROUND OF THE INVENTION

The present invention relates to apparatus for longitudinally slitting moving webs of material, such as synthetic resinous films and the like, to form a plurality of strips or sub-webs. More particularly, the present invention relates to slitting mechanisms especially adapted for use with such apparatus.

Relatively thin sheet materials such as synthetic resinous film, foil, paper, laminate and cloth, are typically manufactured in the form of wide, long webs. Such webs may measure, for example, 6 feet in width by 1,000 feet in length. Each web is usually wound about an elongate cylindrical supply core into a roll for transport and storage. The manufacturer of consumer products from such webs, for example, rolls of synthetic resinous film, usually involves use of an apparatus known as a slitter/rewinder. An apparatus of this character is disclosed in U.S. Pat. No. 2,769,600 to Kwitek et al.

An apparatus for longitudinally slitting moving webs of material typically comprises: (a) a frame means for rotatably supporting, about a first fixed axis, a rolled web of material to be slit; (b) one or more cutting devices, or slitting mechanisms, for slitting the web into a plurality of strips, said devices being disposed adjacent the web of material; (c) a take-up means for winding into individual rolls, strips of material formed by slitting the web of material; and (d) means for guiding the web of material in a path which extends from said support means to said take-up means. The cutting devices are suitably mounted on a support mandrel. The support mandrel is suitably rotatable from a first position wherein the cutting devices, or slitter blade carriers, are disposed adjacent the path of the web to a second position wherein said blade carriers are disposed remote from the path of the web.

In slitting a web of material, a number of cutting devices, or slitting mechanisms, are known. Such devices include knives, scissors, shears and the like. With one device, a web is slit by a cutting wheel bearing on a mandrel. With another device, the web is slit by a blade which bears on a shallow groove formed in the surface of a mandrel over which the web to be cut travels. With still another device, the web is slit by mating sets of blades which bear against each other. All of such devices employ one or more sharp cutting edges to slit the material. These sharp cutting edges are hazardous to an operator or a user. An operator may be exposed to said cutting edges during initial installation of a cutting device into an apparatus for slitting moving webs of material. In addition, cutting edges tend to become dull over time and must either be sharpened or replaced. As such, an operator is exposed to said cutting edges during removal of a cutting device for sharpening or replacement and during reinstallation of said cutting device. More importantly, an operator may be working near the cutting device while performing maintenance on the apparatus. If the cutting edges are not adequately guarded, an operator might easily come in contact with one or more edges, thereby receiving an injury.

SUMMARY OF THE INVENTION

It would be desirable if the device for slitting a moving web of material protected a worker from the risk of being cut or injured while at the same time operating easily and quickly.

Another object is to provide an improved slitter blade holder which is adjustable while the web of material is being slit.

Still another object is to provide an improved slitter blade holder which allows an operator to quickly reverse a cutting blade so that a greater portion of the cutting edge of the blade might be used to slit the web of material.

These and other objects are realized in a slitter blade carrier which comprises, in cooperative combination: (a) a frame; (b) a blade holder which is in slideable engagement with, and which is contained within, the frame; and (c) an activator means for causing the blade carrier to move slideably within the frame, said activator means being connected to the frame and to the blade holder.

BRIEF DESCRIPTION OF THE DRAWINGS

FIG. 2 also shows cutting blades in an exposed position as does FIG. 1.

DESCRIPTION OF THE PREFERRED EMBODIMENTS

Figure 2:
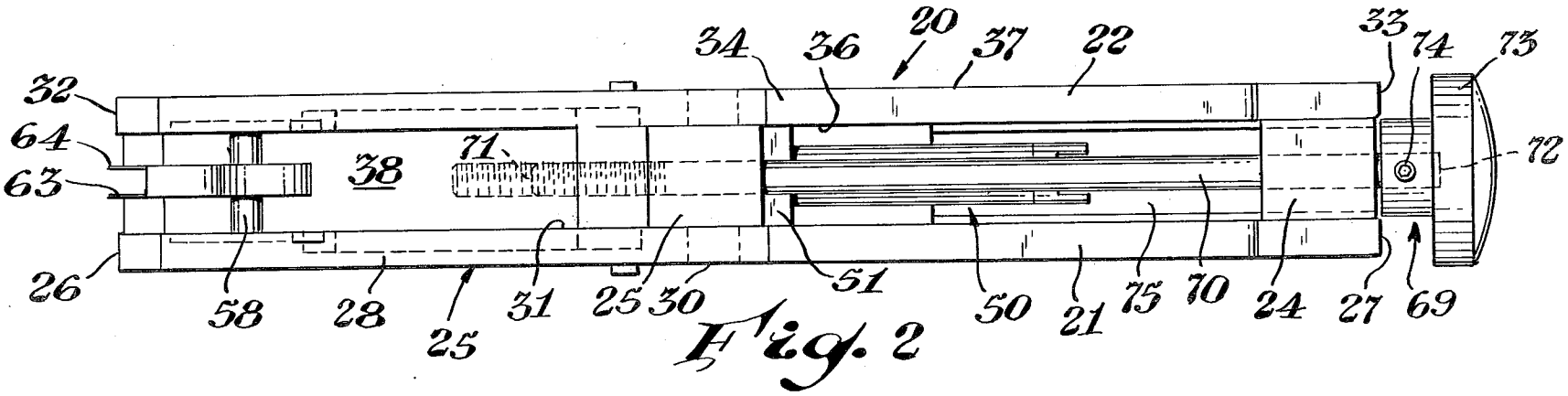
FIG. 2 is a top view of the device shown in FIG. 1.
Figure 1:
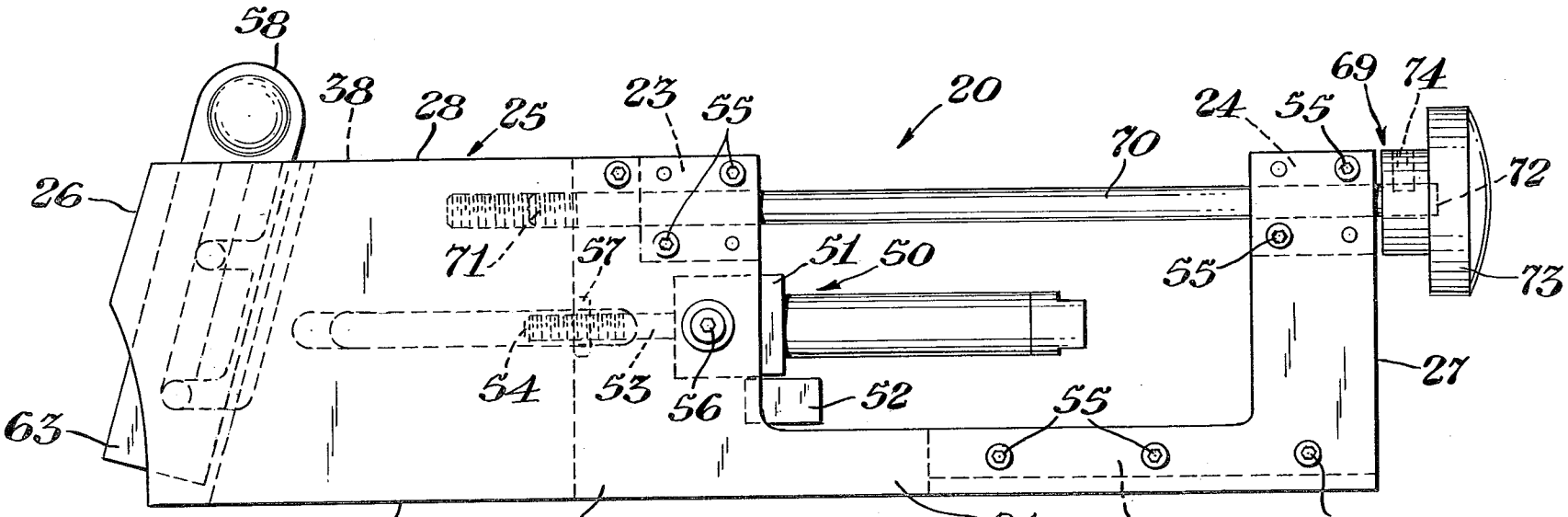
FIG. 1 is a side elevation of a blade carrier in accordance with the present invention and showing slitting blades in an exposed configuration.

Referring to FIGS. 1–2 there is shown generally a blade carrier constructed according to the present invention and generally designated by the reference numeral 20.

The blade carrier 20 includes a first side frame member 21 and a second side frame member 22 (shown only in FIG. 2). The first side frame member 21 and the second side frame member 22 together with a first spacer block 23 and a second spacer block 24 generally comprise a blade carrier housing 25. The first side frame member 21 has a first end 26, second end 27, a first edge 28 and a second edge 29 (not shown in FIG. 2). The first side frame member 21 also has a first side 30 and a second side 31 (shown only in FIG. 2). The second side frame member 22 (shown only in FIG. 2) has a first end 32, a second end 33, a first edge 34, a second edge (not shown), a first side 36 and a second side 37 (all of which are shown only in FIG. 2).

The blade carrier 20 also includes a sliding block 38, a linear actuator assembly 50, a blade guide member 58, a first slitting blade 63, a second slitting blade 64 (shown only in FIG. 2) and a blade engagement adjustment means 69. The blade carrier 20 further includes a mounting bracket 75. Persons skilled in the art will recognize that the shape and configuration of the mounting bracket 75 is not critical. Any shape and configuration will suffice so long as it does not interfere with the operation of the blade carrier 20.

The linear actuator assembly 50 comprises a front trunnion mounted double acting pneumatic cylinder 51, an air return fitting 52 (not shown in FIG. 2) and a piston rod 53 (also not shown in FIG. 2). The piston rod 53 has a first end 54 which projects from the double acting pneumatic cylinder 51 and a second end (not shown). Desirably the first end 54 of the piston rod 53 is externally screw threaded. A locking nut 57 (not shown in FIG. 2) is threadably engaged with the first end 54 of the piston rod 53. The blade carrier 20 is desirably assembled using a number of socket head cap screws 55 (half of which are shown in FIG. 1). The linear actuator assembly 50 is fitted into position by means of socket head cap screws 56 (one of which is shown in FIG. 1). Persons skilled in the art will recognize that the particular type of fastener is not critical so long as fastening is accomplished.

The blade engagement adjustment means 69 comprises a rod 70 and a knob 73. The rod 70 has a first end 71 and a second end 72. Desirably, the first end 71 of the rod 70 is externally screw threaded. The knob 73 is desirably affixed to the second end 72 of the rod 70. As shown in FIGS. 1 and 2, the knob 73 is affixed to the second end 72 of the rod 70 by a socket head cap screw 74. Persons skilled in the art will recognize that the particular type of fastener is not critical so long as fastening is accomplished.

Figure 3:
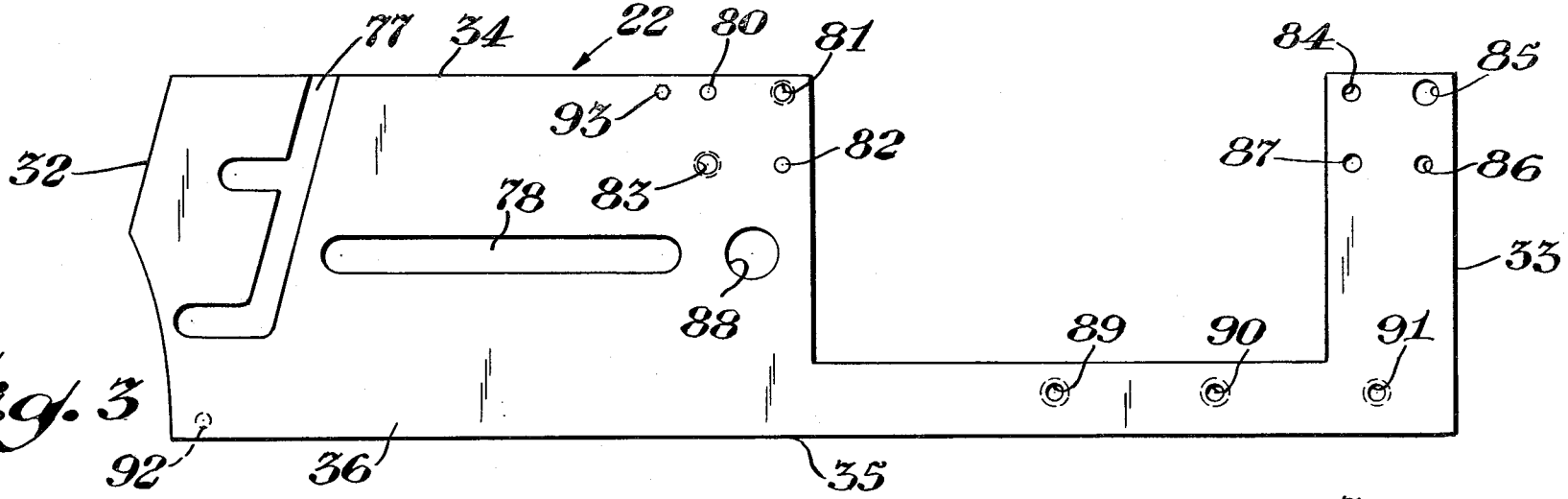
FIG. 3 is a side elevation of a side frame member.

Referring to FIG. 3 there is shown generally the second side frame member 22. The second side frame member 22 has a first end 32, a second end 33, a first edge 34, a second edge 35, a first side 36 and a second side (not shown). The second side frame member 22 has defined therein a blade guide member channel 77 and a sliding block guide channel 78. The second side frame member 22 also has defined therein four first spacer block mounting apertures 80, 81, 82 and 83, four second spacer block mounting apertures 84, 85, 86 and 87, a trunnion mounting aperture 88, three bracket mounting apertures 89, 90 and 91 and two guard device mounting apertures 92 and 93. Desirably the first spacer block mounting apertures 80 and 82, the second spacer block mounting apertures 84 and 86 and the trunnion mounting aperture 88 are smooth surfaced. Desirably the first spacer block mounting apertures 81 and 83, the second spacer block mounting apertures 85 and 87, the three bracket mounting apertures 89, 90 and 91 and the two guard device mounting apertures 92 and 93 are internally screw threaded. Persons skilled in the art will recognize that the number of apertures, the arrangement of the apertures and the design of the apertures (smooth-surfaced or internally screw threaded) are not critical. Any number of apertures and any design or arrangement thereof may be selected so long as the blade carrier housing 25 is generally rigidly connected. The first side frame member 21 is a mirror image of the second side frame member 22.

Figure 5:
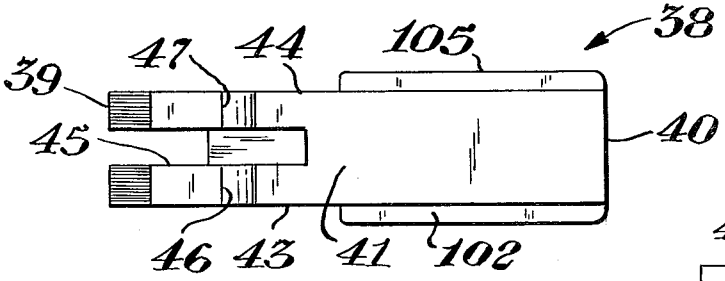
FIG. 5 is a top view of the sliding block shown in FIG. 3.
Figure 6:
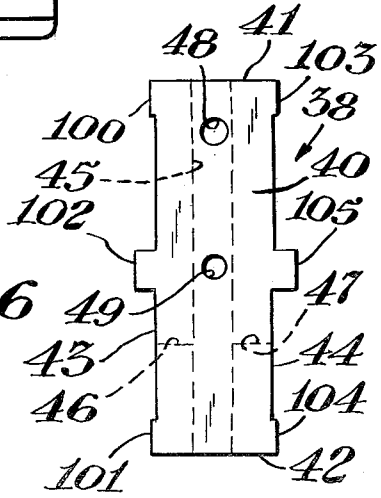
FIG. 6 is an end elevation of the sliding block shown in FIG. 3.
Figure 4:
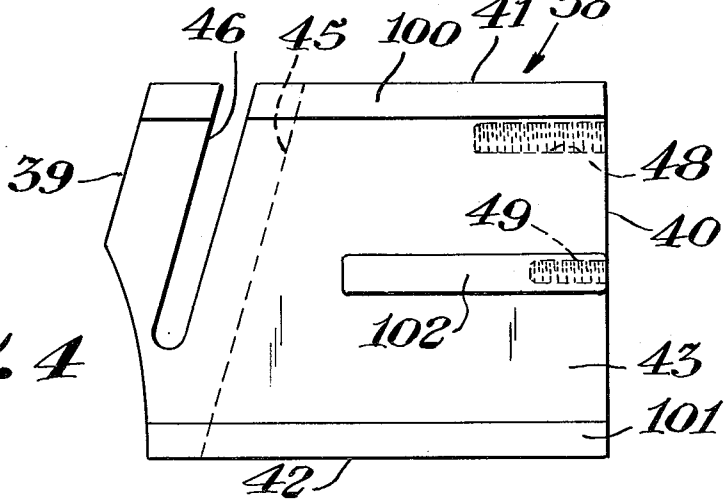
FIG. 4 is a side elevation of a sliding block.

Referring to FIGS. 4–6 there is shown generally a sliding block 38. The sliding block 38 has a first end 39 (not shown in FIG. 6), a second end 40, a first edge 41, a second edge 42 (not shown in FIG. 5), a first side 43 and a second side 44 (not shown in FIG. 4). The sliding block 38 has defined therein a generally angularly disposed recess 45, a first generally angularly disposed slot 46 and a second generally angularly disposed slot 47 (not shown in FIG. 4). The first slot 46 and the second slot 47 are generally parallel to each other and to the recess 45. The first slot 46 and the second slot 47 are also in communication with the recess 45. The sliding block 38 also has defined therein a blade engagement adjustment means connecting aperture 48 (not shown in FIG. 5) and a piston rod connecting aperture 49 (not shown in FIG. 5).

The first side 43 of the sliding block 38 has defined thereon a first edge boss 100 (not shown in FIG. 5), a second edge boss 101 (not shown in FIG. 5) and a sliding block guide channel boss 102. The second side 44 of the sliding block 38 has defined thereon a first edge boss 103 (shown only in FIG. 6), a second edge boss 104 (shown only in FIG. 6) and a sliding block guide channel boss 105 (not shown in FIG. 4). The first edge boss 100, the second edge boss 101 and the sliding block guide channel boss 102 of the first side 43 are generally parallel respectively to the first edge boss 103, the second edge boss 104 and the sliding block guide channel boss 105 of the second side 44.

Figures 7, 8, 9, 10, 11, 12, 13:
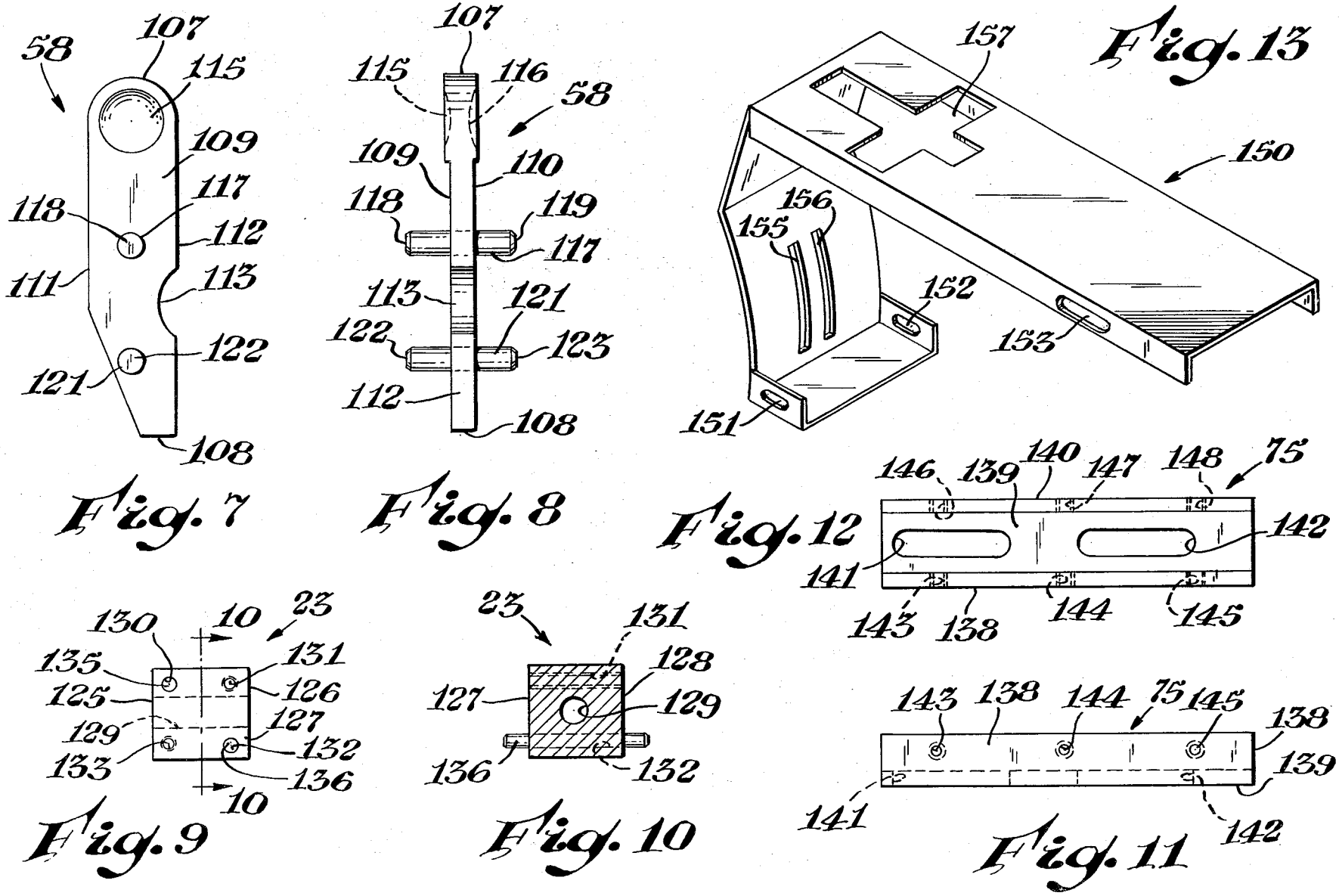
FIG. 7 is a side elevation of a blade guide member.
FIG. 8 is an end elevation of the blade guide member shown in FIG. 7.
FIG. 9 is a side elevation of a spacer.
FIG. 10 is an end view of the spacer shown in FIG. 9 taken generally along line 10—10 in FIG. 9.
FIG. 11 is a side elevation of a mounting bracket.
FIG. 12 is a top view of the mounting bracket shown in FIG. 11.
FIG. 13 is a perspective view of a guard device adapted to be fitted on the slitting device shown in FIG. 1.

Referring to FIGS. 7 and 8 there is shown generally a blade guide member 58. The blade guide member 58 has a first end 107, a second end 108, a first side 109 and a second side 110 (not shown in FIG. 7). The blade guide member 58 also has a first edge 111 (not shown in FIG. 8) and a second edge 112. The second edge 112 of the blade guide member 58 desirably has defined therein a recess 113. The recess 113 is desirably arcuate in shape. Persons skilled in the art will recognize that the recess 113 is not mandatory. Such persons will, however, recognize that the recess 113 is convenient in that it aids in removal of blades from the blade guide member 58. The first side 109 of the blade guide member 58 has defined therein, proximate to the first end 107, a first grasping recess 115. The second side 110 of the blade guide member has defined therein, proximate to the first end 107, a second grasping recess 116 (not shown in FIG. 7). The first grasping recess 115 and the second grasping recess 116 are generally parallel to each other. Persons skilled in the art will recognize that the first and second grasping recesses 115 and 116 are not critical to the present invention. The recesses 115 and 116 do, however, make removal of the blade guide member 58 from the blade carrier housing 25 safer and easier. The blade guide member 58 has affixed thereto a first blade engagement pin 117 and a second blade engagement pin 121. The first blade engagement pin 117 has a first end 118 and a second end 119 (not shown in FIG. 7). The second blade engagement pin 121 has a first end 122 and a second end 123 (not shown in FIG. 7). The first and second blade engagement pins 117 and 121 are generally parallel and positioned in a spaced apart relationship. The spaced apart relationship is desirably such that a blade (not shown) having an aperture (also not shown) is frictionally held in a position generally parallel the first side 109 and the second side 110 (shown only in FIG. 8) by the first and second blade engagement pins 117 and 121.

Referring to FIGS. 9 and 10 there is shown generally a spacer block 23. The spacer block 23 has a first end 125 and a second 126 (both of which are shown only in FIG. 9). The spacer block 23 also has a first side 127 and a second side 128 (shown only in FIG. 10). The spacer block 23 has defined therein a generally central aperture 129. The aperture 129 is in communication with the first end 125 and the second end 126 of the spacer block 23 (see FIG. 9). The aperture 129 desirably has a smooth surface. The spacer block 23 also has defined therein a first aperture 130, a second aperture 131, a third aperture 132 and a fourth aperture 133 (the first aperture 130 and the fourth aperture 133 being visible only in FIG. 9). The first aperture 130 and the third aperture 132 each have a pin, 135 (shown only in FIG. 9) and 136 respectively, in generally fixed engagement therewith. The pins 135 and 136 are desirably positioned so that a portion of each project from both the first side 127 and the second side 128 of the spacer block 23 (see FIG. 10). The second aperture 131 and the fourth aperture 133 (shown only in FIG. 9) are desirably internally screw threaded. The first aperture 130, the second aperture 131, the third aperture 132 and the fourth aperture 133 are generally parallel to each other and generally perpendicular to, but not in communication with, the aperture 129. The first spacer block 23 and the second spacer block 24 are generally identical.

Persons skilled in the art will recognize that the particular design, placement of and number of spacer blocks is not critical. Any arrangement which holds the first side member 21 in a generally fixed, spaced-apart relationship with the second side frame member 22 and which does not interfere with the operation of the sliding block 38 will suffice.

Referring to FIGS. 11–12 there is shown generally a mounting bracket 75. The bracket 75 is generally U-shaped having a first side 138, a second side 140 (not shown in FIG. 11) and a bottom 139. The bottom 139 has defined therein a first elongated aperture 141 and a second elongated aperture 142. The first side 138 has defined therein three internally screw threaded apertures 143, 144 and 145. The second side 140 has defined therein three internally screw threaded apertures 146, 147 and 148 (all of which are not shown in FIG. 11). The screw threaded apertures 143, 144 and 145 are generally respectively coaxial with the screw threaded apertures 146, 147 and 148. Persons skilled in the art will recognize that while a means for mounting the blade carrier 20 is needed, any means may be used so long as it does not interfere with the operation of the sliding block 38. In other words, the number and shape of the apertures is not critical.

Referring to FIG. 13, there is shown generally a guard device 150 adapted to be fitted over the first end 26 of the first side frame member 21 and the first end 32 of the second side frame member 22 of the blade carrier 20 shown in FIGS. 1 and 2.

The guard device 150 has defined therein a first mounting aperture 151, a second mounting aperture 152, a third mounting aperture 153 and a fourth mounting aperture (not shown). The first mounting aperture 151 and the second mounting aperture 152 are spaced apart and generally parallel. The third mounting aperture 153 and the fourth mounting aperture (not shown) are spaced apart and generally parallel. As shown, the first, second and third mounting apertures, 151, 152 and 153 respectively, are elongated to allow for variation in location of guard device mounting apertures on the blade carrier 20 (see FIGS. 1 and 2). The guard device also has defined therein a first blade receiving aperture 155 and a second blade receiving aperture 156. The first blade receiving aperture 155 and the second blade receiving aperture 156 are spaced apart and generally parallel. The blade receiving apertures 155 and 156 are positioned so that when the blades 63 and 64 are in the position shown in FIG. 2, the blades 63 and 64 project respectively through the apertures 155 and 156. The guard device 150 further has defined therein a blade guide receiving aperture 157. The blade guide receiving aperture 157 is desirably in the shape of a cross with a long axis generally parallel to the first side frame member 21 of the blade carrier 20 (see FIGS. 1 and 2) when the guard device 150 is in position.

The blade carrier 20 is shown in FIGS. 1 and 2 with the blades 63 and 64 (FIG. 2 only) in the forward or engaged position.

In operation the sliding block guide channel bosses 102 and 105 (see FIGS. 4–6) are in slidable engagement respectively with the sliding block guide channel 78 of the second side frame member 22 (see FIG. 3) and the sliding block guide channel (not shown) of the first side frame member 21. The first end 54 of the piston rod 53 (see FIGS. 1 and 2) is threadably engaged with the piston rod connecting aperture 49 of the sliding block 38 (see FIGS. 4 and 6). The first end 71 of the rod 70 (see FIGS. 1 and 2) is threadably engaged with the blade engagement adjustment means aperture 48 of the sliding block 38 (see FIGS. 4 and 6). The first and second blade engagement pins 117 and 118 of the blade guide member 58 (see FIGS. 7 and 8) are in slidable engagement with blade guide member channel 77 of the second side frame member 22 (see FIG. 3) and with the blade guide member channel (not shown) of the first side frame member 21 (see FIGS. 1 and 2). The first and second blade engagement pins, 117 and 118, of the blade guide member 58 are also in slidable engagement with the first and second angularly disposed slots, 46 and 47, of the sliding block 38 (see FIGS. 4–6). The blade guide member 58 is in slidable engagement with the angularly disposed recess 45 of the sliding block 38 (see FIGS. 4 and 6). As shown in FIGS. 1 and 2, the first slitting blade 63 and the second slitting blade 64 (FIG. 2 only) are slidably fitted onto the blade engagement pins 117 and 118 of the blade guide member 58 (see FIGS. 7 and 8). The rod 70 (see FIGS. 1 and 2) of the blade guide adjustment means 69 (see FIGS. 1 and 2) is in slidable engagement with the central aperture 129 of the first spacer block 23 (see FIGS. 9 and 10) and with the central aperture (not shown) of the second spacer block 24 (see FIGS. 1 and 2).

When the double-acting pneumatic cylinder 51 (see FIGS. 1 and 2) causes the first end 54 of the piston rod 53 to move generally away from the pneumatic cylinder 51, the sliding block 38 (see FIGS. 4–6) which is connected to the first end 54 of the piston rod 53 also moves generally away from the pneumatic cylinder 51 to the position shown in FIGS. 1 and 2. The extent to which the sliding block 38 is moved away from the pneumatic cylinder 51 is controlled by the blade adjustment means 69. The knob 73 of the blade adjustment means 69 (see FIGS. 1 and 2) may be turned so as to cause the first end 71 of the rod 70 to become threadably engaged to a greater or lesser extent with the piston rod connecting aperture 49 of the sliding block 38 (see FIGS. 4 and 6). A greater engagement of the first end 71 of the rod 70 with the aperture 49 of the sliding block 38 results in a lesser movement of the sliding block 38 away from the pneumatic cylinder 51 when the pneumatic cylinder causes the first end 54 of the piston rod 53 to move away from the pneumatic cylinder 51. The reverse is true when a lesser engagement of the first end 71 of the rod 70 with the aperture 49 of the sliding block 38 is effected. The knob 73 also functions as a stop to prevent further movement of the sliding block 38 toward the first ends 26 and 32 of the first and second side frame members 21 and 22 respectively.

When the pneumatic cylinder 51 (FIGS. 1 and 2) causes the first end 54 of the piston rod 53 to move generally toward the pneumatic cylinder 51, the sliding block 38 also moves toward the pneumatic cylinder 51 and into a retracted position (not shown). In the retracted position, the blades 63 and 64 (FIG. 2) do not project outward from the first ends 26 and 32 of the first and second side frame members 21 and 22 respectively. As such, when the guard device 150 (FIG. 13) is fixed in position, the blades 63 and 64 do not project through the first and second blade receiving apertures 155 and 156 respectively. Persons skilled in the art will recognize that the guard device 150 is in position when the mounting apertures (three of which, 151, 152 and 153 are shown) of the guard device 150 are proximate to guard device mounting apertures (two of which, 92 and 93, are shown in FIG. 3). Desirably the guard device will be fixed in position by means of socket head cap screws (not shown).

The guard device 150 (FIG. 13) is desirably employed inasmuch as it markedly reduces the risk that a worker might be cut or injured.

Persons skilled in the art will recognize that when the sliding block 38 is in a retracted position, the blade guide member 58 may be easily removed from the blade carrier housing 25 (see FIGS. 1 and 2). As such, the blades 63 and 64 (FIG. 2) may be quickly reversed end-for-end or replaced. Skilled artisans will also recognize that the blade adjustment means 69 (FIGS. 1 and 2) allows an operator to adjust the extent to which the blades 63 and 64 (FIG. 2) project outward from the first ends 26 and 32 respectively of the first and second side frame members 21 and 22 while material is being slit.

What is claimed is:

1. A slitter blade carrier which comprises, in cooperative combination:

(a) a frame;

(b) a blade holder which is in slideable engagement with, and which is contained within the frame, the blade holder comprising a sliding block, the sliding block being in slideable engagement with the frame, in cooperative combination with a blade guide member, the blade guide member being in slideable engagement with the sliding block, said sliding block having a first end and a second end, the sliding block also having defined therein a generally angularly disposed recess, a first generally angularly disposed slot and a second generally angularly disposed slot, the first slot and the second slot being generally parallel to each other and to the recess, the first slot and the second slot further being in communication with the recess;

(c) an actuator means for causing the blade carrier to move slideably within the frame, said actuator means being connected to the frame and to the blade holder; and (d) a blade engagement adjustment means, said adjustment means being operatively connected to the frame and to the blade holder.

2. The slitter blade carrier of claim 1 wherein the blade guide member has affixed thereto a first blade engagement pin and a second blade engagement pin, the first pin and the second pin being generally parallel and in a spaced apart relationship, the spaced apart relationship being sufficient to hold a slitting blade in a generally fixed position with respect to the blade carrier when a slitting blade is fitted over the first pin and the second pin.

3. The slitter blade holder of claim 2 wherein blade guide member is in slideable engagement with the generally angularly disposed recess which is defined within the sliding block and the first pin and the second pin of the blade guide member is in slideable engagement with the first and second generally angularly disposed slots which are defined within the sliding block.

4. The slitter blade holder of claim 3 wherein the actuator means is a linear actuator means.

5. The slitter blade holder of claim 4 wherein the frame has a first end and a second end.

6. The slitter blade holder of claim 5 wherein the sliding block is selectively and slideably movable from a first position wherein the first end of the sliding block is generally proximate to the first end of the frame to a second position wherein the first end of the sliding block is generally remote from the first end of the frame.

7. The slitter blade holder of claim 6 wherein the extent to which the sliding block slideably moves toward the first end of the frame is controlled by the blade engagement adjustment means.

8. The slitter blade holder of claim 7 wherein at least a first slitter blade is fitted over the first and second pins of the blade guide member in such a manner that a cutting edge of said blade is generally proximate to the first end of the sliding block and generally remote from the second end of the sliding block.

9. The slitter blade holder of claim 8 wherein at least a portion of the cutting edge of the slitting blade projects outward from the first end of the frame when the sliding block is in the first position and wherein no portion of the cutting edge of the slitting blade projects outward from the first end of the frame when the sliding block is in the second position.

10. The slitter blade holder of claim 9 further comprising a guard device which is fitted over the first end of the frame, the guard device having defined therein at least a first blade receiving aperture and a second blade receiving aperture, the first and second blade receiving apertures being spaced apart and generally parallel, the first and second blade receiving apertures being positioned so that at least a portion of the cutting edge of the slitting blade projects through an aperture when the sliding block is in the first position.

* * * * *